US009463369B2

(12) United States Patent
Ebsen

(10) Patent No.: US 9,463,369 B2
(45) Date of Patent: Oct. 11, 2016

(54) ACCESSORY FOR GYMNASTIC EXERCISES

(71) Applicant: PE Redskaber A/S, Gram (DK)

(72) Inventor: Preben Ebsen, Rødding (DK)

(73) Assignee: PF Redskaber A/S, Gram (DK)

( * ) Notice: Subject to any disclaimer, the term of this patent is extended or adjusted under 35 U.S.C. 154(b) by 106 days.

(21) Appl. No.: 14/278,096

(22) Filed: May 15, 2014

(65) Prior Publication Data

US 2014/0342879 A1 Nov. 20, 2014

(30) Foreign Application Priority Data

May 15, 2013 (DK) ..... 2013 70262

(51) Int. Cl.

*A63B 26/00* (2006.01)
*A63B 69/00* (2006.01)
*A63B 5/16* (2006.01)

(Continued)

(52) U.S. Cl.

CPC ..... *A63B 69/0064* (2013.01); *A63B 5/16* (2013.01); *A63B 7/00* (2013.01); *A63B 21/4009* (2015.10); *A62B 35/00* (2013.01); *A62B 35/0037* (2013.01); *A63B 5/11* (2013.01); *A63B 21/0552* (2013.01); *A63B 2005/163* (2013.01);

(Continued)

(58) Field of Classification Search

CPC .. A63B 69/00; A63B 69/0064; A63B 21/00; A63B 21/40; A63B 21/4001; A63B 21/4009; A63B 5/00; A63B 5/15; A63B 7/00

USPC ..... 482/23, 51, 74, 78, 38, 43, 142, 143, 482/139, 148

See application file for complete search history.

(56) References Cited

U.S. PATENT DOCUMENTS 2,496,748 A * 2/1950 Pond ..... A63B 7/00 434/247
3,006,645 A * 10/1961 Frazier ..... A63B 69/0064 182/3

(Continued)

FOREIGN PATENT DOCUMENTS

| | | |
|---|---|---|
| CN | 2043887 | 9/1989 |
| DE | 271417 | 9/1989 |
| GB | 940910 | 11/1963 |

*Primary Examiner* — Stephen Crow
*Assistant Examiner* — Garrett Atkinson
(74) *Attorney, Agent, or Firm* — James Creighton Wray; Meera P. Narasimhan

(57) ABSTRACT

The present invention concerns a gymnastic accessory including a twisting ring with an external ring and an internal ring, wherein the two rings are concentrically connected and rotatable in relation to each other about a common axis, wherein the external ring typically includes two connecting devices that are arranged symmetrically at the outer periphery and adapted for joining with an unyielding or elastic rope. The second ring include connecting means at the periphery, the connecting means adapted for mounting of connecting elements for a twisting belt. The invention further concerns a method for reconfiguring such a gymnastic accessory. The new feature of the gymnastic accessory according to the invention is that the twisting ring further include a number of the connecting elements in the form of straps, wherein one or more and preferably all the straps are arranged with joining means for joining with complementary joining means either on the strap itself, on the second ring or on a twisting belt, wherein the straps and/or the joining means further include adjusting means for adjusting the length of the straps and thereby of the spacing between the twisting belt and the second ring of the twisting ring.

18 Claims, 4 Drawing Sheets

(51) Int. Cl.

| | |
|---|---|
| ***A63B 7/00*** | (2006.01) |
| *A62B 35/00* | (2006.01) |
| *A63B 5/11* | (2006.01) |
| *A63B 21/055* | (2006.01) |

(52) U.S. Cl.
CPC ..... *A63B 2209/10* (2013.01); *A63B 2244/08* (2013.01); *A63B 2244/12* (2013.01)

(56) References Cited

U.S. PATENT DOCUMENTS 3,085,357 A * 4/1963 Nissen ..... A63B 5/16 128/DIG. 15
3,372,926 A 3/1968 Murphy
3,868,786 A * 3/1975 Lippe ..... A01K 27/001 446/28
4,275,880 A * 6/1981 Murphy ..... A61H 3/008 482/43
RE33,218 E * 5/1990 Twardosz ..... A63B 21/0724 482/106
4,961,574 A * 10/1990 Lew ..... A63B 69/0064 280/206
5,221,241 A * 6/1993 Bare, II ..... A63B 69/0064 482/124
6,019,608 A * 2/2000 Stark ..... A63B 69/0093 434/253
6,500,102 B1 * 12/2002 Domenge ..... A63B 21/065 446/236
6,520,290 B1 * 2/2003 Carter ..... A62B 35/0037 182/3
7,232,357 B2 * 6/2007 Chen ..... A63B 19/00 446/236
7,753,829 B1 * 7/2010 Schaller ..... A63B 21/0004 482/132
8,042,494 B2 * 10/2011 Markfield ..... A01K 13/006 119/815
2009/0253557 A1 * 10/2009 Klein ..... A63B 21/0004 482/38
2012/0329616 A1 * 12/2012 Theuer ..... A63B 19/00 482/122

* cited by examiner

ACCESSORY FOR GYMNASTIC EXERCISES

This application claims the benefit of Danish Application No. PA 2013 70262 filed May 15, 2013, which is hereby incorporated by reference in their entirety as if fully set forth herein.

FIELD OF THE INVENTION

The present invention concerns a gymnastic accessory for performing gymnastic exercises, the gymnastic accessory including at least a twisting ring, the twisting ring including a first ring, typically an external ring, and a second ring, typically an internal ring, wherein the two rings are concentrically connected and rotatable in relation to each other about a common axis; wherein the first ring further includes at least two connecting means, the connection means preferably arranged symmetrically at the outer periphery of the first ring and adapted for joining with an unyielding or elastic rope, the second ring also including connecting means at the periphery, wherein these connecting means are adapted for direct or indirect mounting of connecting elements to a twisting belt. The invention further concerns a method for reconfiguring such a gymnastic accessory.

BACKGROUND OF THE INVENTION

In connection with performing jumping gymnastics from a floor, from a mat or on a trampoline, or similar elastic gymnastic appliance, the gymnast may either be suspended by two or four straps—typically elastic ropes when using a trampoline and otherwise in unyielding ropes—which are fixed either a distance above the gymnast or at least above the centre of gravity of the gymnast. For some of such specific gymnastic exercises, so-called twisting rings are used by which the gymnast is fixed in the twisting ring via a twisting belt or similar. Wearing this equipment the gymnast can perform jumps, and while the gymnast is in the air a large number of different exercises can be performed, including somersaults and twisting exercises by which the gymnast rotate about his/her transverse and longitudinal axes.

A twisting ring is typically made of metal, e.g. of aluminium, and includes an outer ring and an inner ring, and between these rings bearing balls or rollers are arranged. The inner one of the two rings can thus rotate in relation to the external ring about a common central axis, in principle as known from traditional ball bearings used for countless purposes in e.g. the mechanical industry. The common central axis in the twisting ring corresponds in principle to the longitudinal axis of a gymnast when he/she is situated in the twisting ring.

The outer ring typically includes fixing means in the form of eyelets or similar which are spaced apart about 180° at the outer periphery of the outer ring. These eyelets are used for fixing the mentioned elastic ropes—typically one or more—at each side.

At the periphery of the inner ring there is also arranged a number of fixing means/eyelets through which a wire, a rope or an elastic rope is drawn. Straps arranged at the external side of the twisting belt are then fixed to this rope.

The twisting belt causes the gymnast to be supported at least by a belt around the waist but frequently with belts/straps around each of the legs/thighs as well, such as known from climbing equipment and other types of safety belts. Twisting belts have, however, typically four straps along the external periphery through which the mentioned rope/wire is drawn. It is thus the length of the straps and the stiffness of the rope that determine the mutual adjusting options between twisting ring and twisting belt.

The number of these eyelets varies from twisting ring to twisting ring, and typically there are between 6 and 10 of such eyelets which are more or less evenly distributed along the periphery of the inner ring of the twisting ring.

Many eyelets on the inner ring provide that the twisting belt itself and thereby the gymnast can be centred better in the twisting ring, which is very important for optimal performance of the exercises. However, at the same time this will imply that the possibility of a good and optimal tightening/strapping of the twisting belt to the gymnast's body is poorer as the twisting belt is fixed relatively firmly at the centre of the twisting ring.

Few eyelets on the inner ring entail that the twisting belt and thereby the gymnast cannot easily be centred in the twisting ring, which is, as mentioned, very important for optimal performance of the exercises. However, fewer eyelets provide better possibility of a good and optimal tightening/strapping of the twisting belt to the gymnast's body as the twisting belt is more flexibly fixed to the twisting ring due to the fewer eyelets.

So, irrespectively whether there are many or few eyelets, there are thus some inexpediencies by the known solutions as either there is a good centrering of the twisting belt or a good tightening to the gymnast's body; both conditions are important but only one of the conditions can be achieved optimally. However, on some twisting rings this has been attempted solved, either by mounting steelwires or elastic ropes in the eyelets in order to optimise the possibility of a simultaneous good centrering of the gymnast and for a perfect tightening of the twisting belt to the body of the gymnast. Still, none of the prior art solutions are optimal as to allowing a gymnast to be centred together with optimal and individual tightening/strapping of the twisting belt to the body. Therefore it is typically necessary to acquire twisting rings as well as internally mounted twisting belts in different sizes where one of the accessible sizes in the one fitting the best—in the best case it fits well—but in far the most cases these twisting rings with permanently mounted twisting belts only fit tolerably.

Moreover, it is common to have two, three or more twisting rings with twisting belts in each size at one's disposal, typically three different sizes, such that a gymnast can put the equipment on and be ready for performing the exercise while another gymnast is already in action.

Such twisting rings with mounted twisting belts are relatively expensive, and it would therefore be very attractive to suffice with purchasing as few as possible and at the same time achieve a great flexibility during use such that e.g. a trampoline and the elastic ropes can be utilised optimally.

By the prior art products an optimal solution is not possible as there is a need for a large number of expensive twisting rings and as in many cases an optimal tightening of the twisting belt to the gymnast's body is not achieved.

An example of a gymnastic accessory for performing gymnastic exercises including a twisting ring with an external and internal ring that are concentrically connected is known from U.S. Pat. No. 2,496,748.

OBJECT OF THE INVENTION

It is the object of the invention to indicate an improved twisting ring with twisting belt where the twisting belt can be optimally adapted to the individual gymnast and where the twisting belt and thereby the gymnast can be centred optimally in the twisting ring as well. It is furthermore the object of the invention to indicate a more flexible and adjustable twisting ring where the twisting ring enables adapting the position of straps on the twisting belt as well as of the belts/straps placed around the legs/thighs of the gymnast.

DESCRIPTION OF THE INVENTION

As mentioned in the introduction and in claim 1, the invention concerns a gymnastic accessory for performing gymnastic exercises, the gymnastic accessory including at least a twisting ring, the twisting ring including a first ring, typically an external ring, and a second ring, typically an internal ring, wherein the two rings are concentrically connected and rotatable in relation to each other about a common axis; wherein the first ring further includes at least two connecting means, the connection means preferably arranged symmetrically at the outer periphery of the first ring and adapted for joining with an unyielding or elastic rope, the second ring also including connecting means at the periphery, wherein these connecting means are adapted for direct or indirect mounting of connecting elements to a twisting belt; the twisting ring further including a number of the connecting elements in the form of straps, preferably four or more straps, wherein one or more and preferably all the straps are arranged with joining means for joining with complementary joining means either on the strap itself, on the second ring or on a twisting belt; wherein the straps and/or the joining means further include adjusting means for adjusting the length of the straps and thereby the spacing between the twisting belt and the second ring in the twisting ring.

The new feature of a gymnastic accessory according to the invention is that the second ring includes a cutout—a groove—along the periphery, the cutout including an opening adapted for receiving one or more connecting elements, wherein the opening has a dimension which is narrower than the cutout itself. It is thus possible to place e.g. the end of a strap of a twisting belt in the cutout through the narrow opening and subsequently lock the end of the strap such that it cannot be pulled out of the narrow opening. The great advantage of the cutout is that the positions of the straps can be chosen freely and thus be adapted to the individual gymnast by a simple displacement to one or the other side. At the same time there are no limits to the positions of the straps which by the prior art solutions can be located only between the eyelets formed on the internal ring in the twisting ring and where the straps are mounted on a steel wire or on a strong elastic band.

In that the mentioned connecting elements are equipped with joining means, it is possible that a twisting belt can readily be mounted as well as dismounted in a twisting ring. This means that one does not necessarily need to have several twisting rings at disposal, but only a number of twisting belts. This has obviously a significant impact on the economy as the twisting rings are clearly the most expensive part. The connecting elements/straps may at the same time advantageously be made with adjustable length. Hereby is achieved a great advantage when positioning the gymnast accurately in the twisting ring. The twisting belt can be adapted optimally to the individual gymnast by adjustable connecting elements/straps. This means that there is no longer need for a compromise between optimal tightening of a twisting belt and optimal centrering in the twisting ring.

In a variant of a gymnastic accessory according to the invention, the connecting elements may include joining means including hook and loop fasteners. By making connecting elements/straps with an adjustable closure means with hook and loop fasteners, they can easily be adjusted in length by loosening and extending/shortening the strap and locking it again by the hook and loop fasteners. At the same time it is easy to open and thereby detach the twisting belt (and the gymnast) from the twisting ring.

In another variant of a gymnastic accessory according to the invention, the connecting elements may include joining means including mechanical coupling elements. Such mechanical coupling elements may e.g. be couplings or buckles between twisting ring and twisting belt. For example, buckles known from safety belts, rucksacks, guitar slings, etc. can be applied. This type of coupling elements can be named together as "snap-buckles", though other types of coupling elements may be used as well. By using couplings between twisting ring and twisting belt it can be sufficient with one twisting ring and it is possible to couple gymnasts wearing twisting belt to the twisting ring immediately before performing the gymnastic exercises.

By the prior art solutions, different sizes of twisting rings with permanently mounted twisting belts are required for adapting to gymnasts of different sizes. According to prior art, typically there are twisting rings with twisting belts in three sizes at disposal, and often two twisting rings of each size, in order to meet the demand reasonably rapidly and flexibly when several users want to perform the exercises in question.

When using coupling means between the twisting ring and the twisting belt, one twisting ring can be used for several twisting belts in various sizes, and the twisting ring does not need to be dismounted from unyielding or elastic ropes when a new gymnast is to go into action.

Moreover, the mechanical coupling means can be retrofitted on existing twisting rings and on most twisting belts. Alternatively, only the twisting belts may be replaced and the somewhat more expensive twisting rings be retained. However, as mentioned it will often be possible to retrofit such coupling means on existing twisting belts by mounting coupling means in the straps previously mounted to the wire or elastic band that is mounted on the internal ring of the twisting ring.

The adjustable joining means, which thus can be made with buckles of suitable type, can be mounted on the twisting ring or on the twisting belt, or on both. By using a compact buckle known from shoulder straps for parachutes where at it is possible to adjust the length of the strap at least on one of the parts, a very robust, secure and compact solution is achieved.

For example, between twisting ring and twisting belt there may be arranged a number, typically four, couplings that readily will provide for coupling together of the two parts, and not the least for mutual adjustment. It is thus possible to suffice with a standardised twisting ring in which several sizes of twisting belts can be fixed according to the size of the gymnast. By enabling adjustment of the fixing straps between the two belts there is achieved, as mentioned above, an optimal possibility of centrering the gymnast in a hitherto unseen way. This improved centrering simultaneously with a more secure/tight strapping of the twisting belt enhances the satisfaction of the user as a markedly improved control is achieved when performing the gymnastic exercises.

A gymnastic accessory according to the invention may advantageously include one or more locking means adapted for disposition in the cutout/groove in the second ring, wherein the locking means is/are adapted for connection with one or more of the connecting elements. In its simplest form it is a strap end where the end consists of a folded strap, i.e. two layers, which is placed in the cutout, and then placing a mandrel, a rod, a rope or the like between these two layers at the end of the strap. The strap is blocked in the cutout hereby in a secure and efficient way.

The gymnastic accessory according to the invention may include that the locking means is constituted by a rod- or ring-shaped element with a cross-sectional geometry which is smaller than the cross-sectional geometry of the cutout. The blocking thus occurs in that the rod/ring is displaced into the cutout through an opening arranged for the purpose in the second/internal ring in the twisting ring. The required straps can be mounted on this ring and may then be freely moved exactly to the desired individual position on the internal periphery on the twisting ring. The locking device can be passed through one or more eyelets on the connecting elements/straps between twisting ring and twisting belt and/or twisting ring and leg belts/straps. By this solution leg belts/straps can be "loose" in relation to the part of the twisting belt fastened around the waist of the gymnast, providing increased flexibility and adjustment options. At the same time, all straps can be fully adjustable. Leg straps/belts/straps can be fixed displaceably in the internal ring as well as the twisting belt itself. All the parts can be pushed and displaced in relation to each other for optimal centrering of the gymnast and for simultaneous tightening the twisting belt on the gymnast.

A gymnastic accessory according to the invention can be designed such that at least either the first or the second ring is made entirely or partially of fibre composite material, wherein the fibres e.g. are glass fibres, carbon fibres, plant fibres or combinations thereof. Hereby a strong and very robust product can be achieved. However, it is obvious that all or parts of the two rings in the twisting ring can also be made of other suitable materials, including aluminium, which advantageously can be rolled, extruded profiled items and/or items that are machined by chip removing processes.

Also, a gymnastic accessory according to the invention can be made such that a number of bearing balls and/or bearing rollers are arranged between the first and the second ring, the bearing balls and bearing rollers being made of steel, ceramics or other suitable dimensionally stable and wear resistant material in order hereby to achieve sufficiently low rolling resistance between the two rings in the twisting ring.

The invention furthermore includes a method for reconfiguration of a gymnastic accessory, wherein the gymnastic accessory is a twisting ring with a first, outer ring and with a second, inner ring, the twisting ring further including a twisting belt that includes a number of connecting elements/straps at its periphery, the connecting elements being fixed to the second, inner ring via an unyielding or elastic rope.

The new feature of the method according to the invention is that the method at least includes the following steps:

- releasing the connecting elements/straps from the unyielding or elastic rope;
- mounting longitudinally adjustable joining means directly or indirectly to the twisting belt via the connecting elements/straps at the periphery of the twisting belt;
- mounting the longitudinally adjustable joining means directly or indirectly to the second ring in the twisting ring via the unyielding or elastic rope at the periphery of the second ring of the twisting ring.

Already purchased twisting rings can thus readily be reconfigured to have adjustable joining means—straps—between the twisting belt and the twisting ring itself. Since twisting rings are relatively expensive, it is a very attractive solution, and though there are still eyelets on the internal ring in which the unyielding or elastic rope is arranged, there is a substantial advantage in being able to adjust—adapt in length—the straps that are between the twisting belt and the twisting ring.

A further step in a method according to the invention includes the following step:

- mounting a mechanical snap-buckle between a twisting belt and a second, inner ring of a twisting ring, wherein one part, e.g. a male part of a snap-buckle, is mounted on a twisting belt and wherein a second part, e.g. a female part of a snap-buckle, is mounted on the second, inner ring of a twisting ring. The previously mentioned advantages and flexibility are hereby achieved.

DESCRIPTION OF THE DRAWING

The invention is described in the following with reference to the drawing, wherein.

In the explanation of the Figures, identical or corresponding elements will be provided with the same designations in different Figures. Therefore, no explanation of all details will be given in connection with each single Figure/embodiment.

LIST OF DESIGNATIONS

Figure 1:
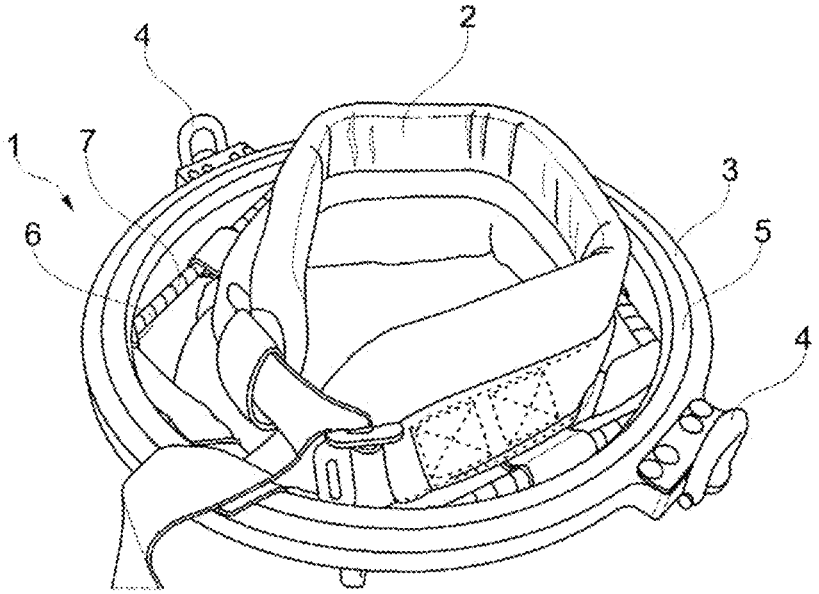
FIG. 1 shows a twisting ring with twisting belt according to prior art.

1 Twisting ring
2 Twisting belt
3 First/external ring
4 Connecting means on first/external ring
5 Second/internal ring
6 Connecting means on second/internal ring
7 Unyielding or elastic rope in the second/internal ring
8 Connecting elements/straps
9 Joining means/coupling elements
10 Eyelets in internal ring
11 Adjusting means
12 Locking means
13 Cutout for bearing balls/rollers on outer periphery of the second/internal ring
14 Bearing balls/rollers
15 Cutout in internal periphery of the second/internal ring
16 Internal area in internal cutout
17 Opening in internal cutout
18 Inlet opening in internal cutout
19 Locking means in internal cutout

DETAILED DESCRIPTION OF EMBODIMENTS OF THE INVENTION

In FIG. 1 appears a twisting ring 1 with twisting belt 2 according to prior art. The external ring 3, also called the first ring 3, is shown here with two connecting means 4 in which the twisting ring 1 can be suspended by not shown ropes. The external ring 3 is coaxially and rotatably connected to the internal ring 5, also called the second ring 5. On the second ring 5 there is arranged connecting means 6 for the twisting belt 2. In the shown variant these connecting means 6 are constituted by a number of eyelets where in these eyelets there is arranged an elastic rope 7 to which the twisting belt 2 itself is fixed. By using an elastic rope 7, the twisting belt 2 can be more easily pulled to the gymnast's body in order to achieve optimal tightening. However, this does not entail optimal centrering of the gymnast in twisting ring 1 itself.

Figure 2:
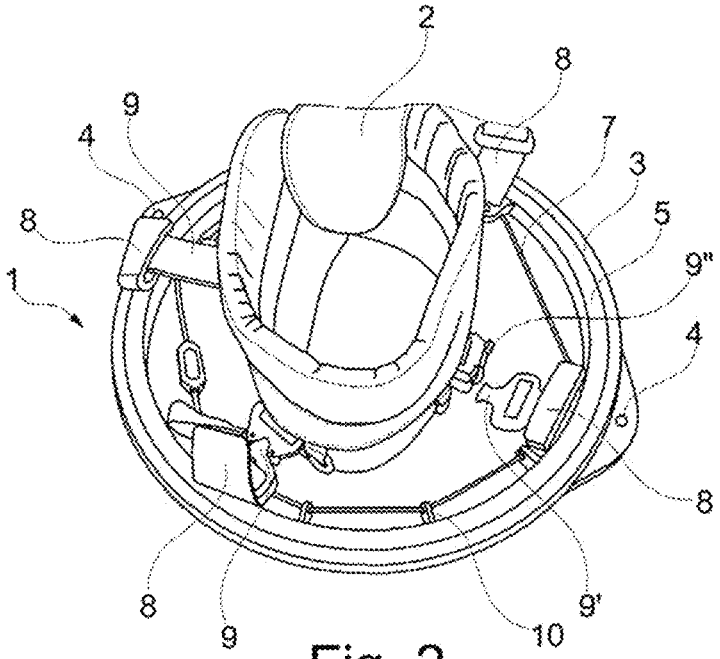
FIG. 2 shows a twisting ring with twisting belt with adjustable straps.

FIG. 2 shows a twisting ring 1 with mounted twisting belt 2 where between the twisting belt 2 and the internal ring 5 of the twisting ring there are adjustable straps 8. On the said straps 8 there are arranged joining means/coupling elements 9 of which one is shown open, enabling rapid and simple joining between a twisting belt 2 and a twisting ring 1. The gymnast can thus put on the twisting belt 2 and, when time comes, easily secure himself/herself in the twisting ring 1. The mentioned joining means/coupling elements 9 have one part 9' fixed to the above mentioned connecting means 6 in the internal ring 5 which is here constituted by an unyielding rope 7 mounted in eyelets 10. The second part 9" of the joining means/coupling elements 9 is fixed to the twisting belt 2.

Figure 3:
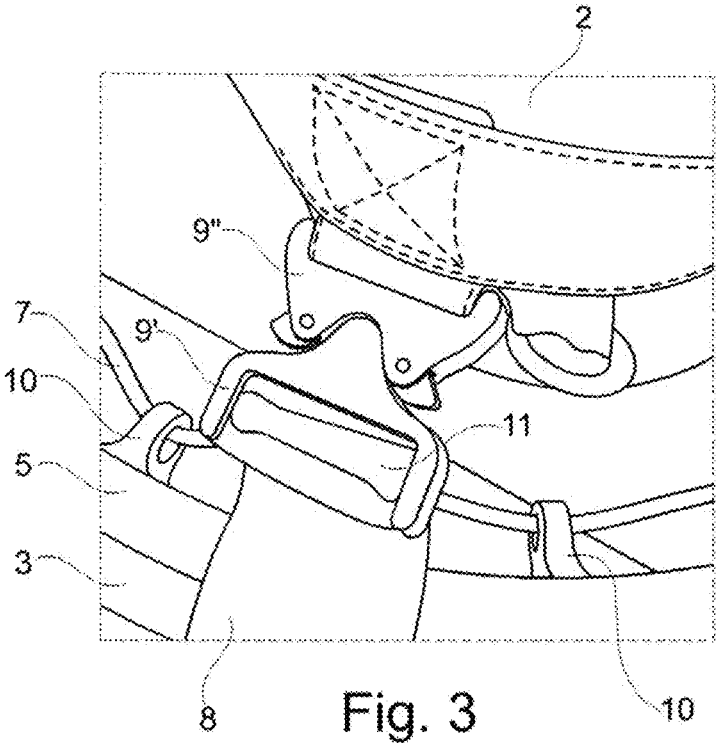
FIG. 3 shows an adjustable snap-buckle between a twisting belt and a twisting ring.

In FIG. 3 are shown joining means/coupling elements 9 in the form of an adjustable snap-buckle between a twisting belt 2 and a twisting ring 1. One part of the joining means/coupling element 9' is fixed to the unyielding rope and the second part 9" is fixed to the twisting belt 2. Between the unyielding rope 7 and one part 9' of the joining means/coupling element 9 the strap 8 itself is mounted in adjusting means 11 relative to the one part 9' of the joining means/coupling element. Hereby is achieved possibility of adjusting the length of the strap and thereby centrering the twisting belt perfectly relative to the twisting ring 1 while at the same time the twisting belt 2 is perfectly strapped to the body of the gymnast.

Figure 4:
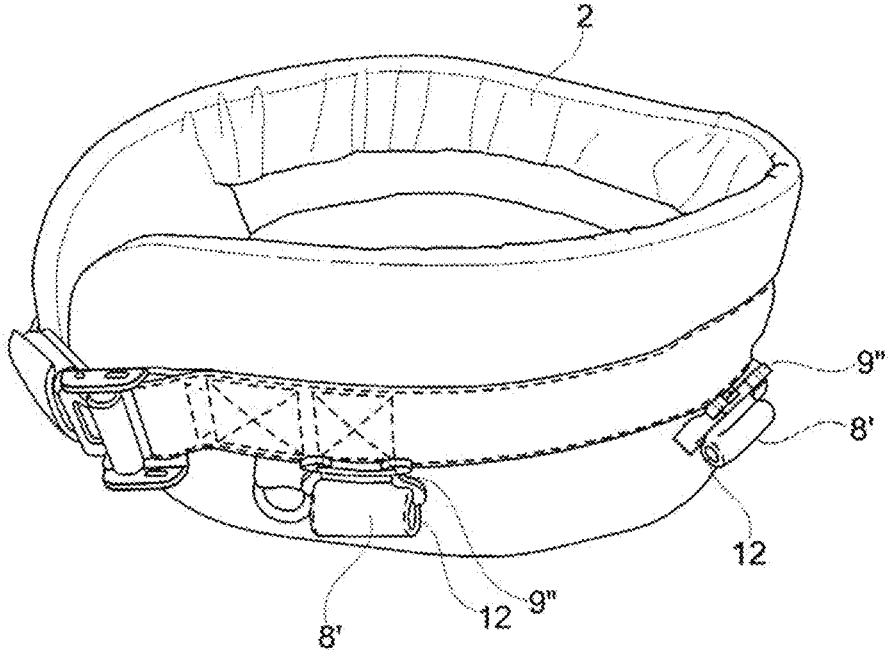
FIG. 4 shows a twisting belt with mounted snap-buckle parts.

In FIG. 4 appears a twisting belt 2 with mounted joining means/coupling elements 9". It is here a quite common standard twisting belt 2, only equipped with the advantageous joining means/coupling elements 9 and therefore readily capable of being coupled to the internal ring 5. The strap 8' on the twisting belt 2 is here passed through a slot in the joining means/coupling element 9" and subsequently blocked by a locking means 12.

Figure 5:
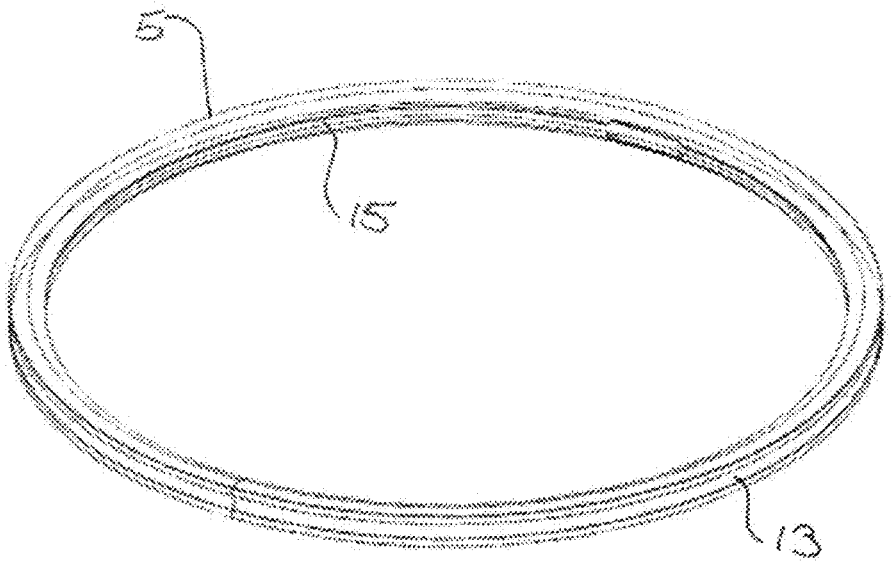
FIG. 5 shows the internal ring for a twisting ring.

FIG. 5 shows the internal ring 5 for a twisting ring 1 where on the external periphery there is arranged a cutout 13 for not shown bearing balls/rollers 14. In principle this is a cutout 13 largely corresponding to such appearing on current types of ball/roller bearings. On the external periphery on the internal ring 5 there is seen a cutout 15 for completely free disposition of the straps 8 connecting a twisting belt 2 with the twisting ring 1.

Figure 6:
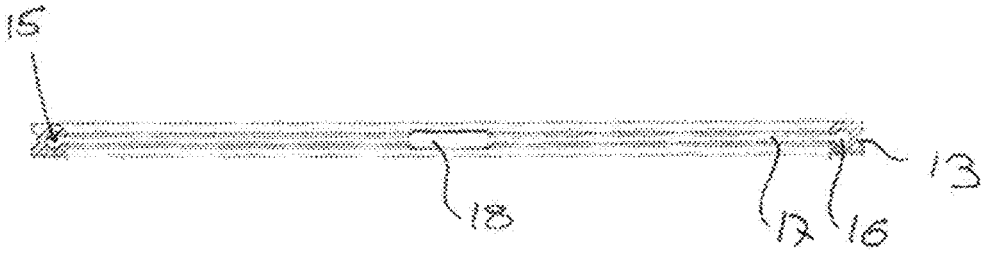
FIG. 6 shows a cross-section of the internal ring.

In FIG. 6 appears a cross-section of the same internal ring 5, as shown in FIG. 5. The cutout 15 appears here with a greater internal height 16 than the height of the opening 17 itself. Moreover, an insertion opening 18 appears through which straps 8 or other means can be inserted into the cutout 15. This will be shown and described in more detail in FIG. 7. FIG. 6 also shows the previously mentioned external cutout 13 for not shown bearing balls/rollers 14.

Figure 7:
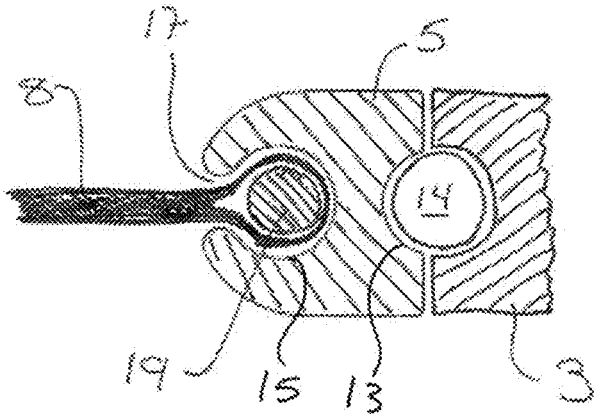
FIG. 7 shows yet a cross-section of the internal ring with cutouts, strap and locking means.

Finally, FIG. 7 shows a cross-section of part of the external ring 3 and of the internal ring 5 with cutouts 13 and with bearing balls/rollers 14. A strap 8 is arranged in the cutout 15 in the internal ring wherein the strap 8 forms an eyelet and where in this eyelet a locking means 19 is arranged. In this way it will be possible to displace the strap 8—typically there will be four straps 8 between the internal ring 5 and the twisting belt 2, and maybe one or two straps 8 for each of two leg belts—along the periphery of the internal ring 5. The straps 8 can hereby be positioned entirely according to the user's wish, and it is therefore possible to achieve an optimal and hitherto unseen perfect tightening/strapping of the twisting belt 2 to the gymnast while at the same time a perfect centrering of the gymnast in the twisting ring 1 is achieved.

The invention claimed is:

1. A gymnastic accessory for performing gymnastic exercises, the gymnastic accessory including at least a twisting ring, the twisting ring including a first ring, and a second ring, wherein the two rings are concentrically connected and rotatable in relation to each other about a common axis; wherein the first ring further includes at least two connecting means, the connecting means arranged symmetrically at an outer first ring periphery of the first ring and adapted for joining with a rope, the second ring also including connecting means at an inner second ring periphery, wherein these connecting means are adapted for mounting of connecting elements to a twisting belt; the twisting ring further including a number of the connecting elements in the form of straps, wherein at least one strap is arranged with joining means for joining with complementary joining means on one of: the strap, the second ring, the twisting belt; wherein one of the straps and the joining means further include adjusting means for adjusting the length of the straps and thereby the spacing between the twisting belt and the second ring in the twisting ring, wherein the second ring includes a groove continuous along an inner circumference of the inner second ring periphery towards a center of the twisting ring, the groove including an opening adapted for receiving at least one connecting element, wherein the opening has a dimension which is narrower than the groove.

2. A gymnastic accessory according to claim 1, wherein the joining means include hook and loop fasteners.

3. A gymnastic accessory according to claim 1, wherein the joining means include mechanical coupling elements.

4. A gymnastic accessory according to claim 1, wherein the gymnastic accessory includes at least one locking means adapted for disposition in the groove in the second ring, wherein the locking means is/are adapted for connection with at least one of the connecting elements.

5. A gymnastic accessory according to claim 4, wherein the locking means is constituted by a rod-shaped element with a cross-sectional geometry which is smaller than the cross-sectional geometry of the groove.

6. A gymnastic accessory according to claim 4, wherein the locking means is constituted by a ring-shaped element with a cross-sectional geometry which is smaller than the cross-sectional geometry of the groove.

7. A gymnastic accessory according to claim 1, wherein at least one of the first and the second ring is made at least partially of fibre composite material.

8. The accessory of claim 7, wherein the fibre composite material is selected from the group consisting of glass fibres, carbon fibres, plant fibres, and combinations thereof.

9. A gymnastic accessory according to claim 1, wherein a number of bearing balls is arranged between the first and the second ring, the bearing balls being made of steel, ceramics, other suitable dimensionally stable and wear resistant material.

10. A gymnastic accessory according to claim 1, wherein a number of bearing rollers is arranged between the first and the second ring, the bearing rollers being made of steel, ceramics, other suitable dimensionally stable and wear resistant material.

11. A gymnastic accessory according to claim 1, wherein a number of bearing balls and bearing rollers are arranged between the first and the second ring, the bearing balls and bearing rollers being made of steel, ceramics, other suitable dimensionally stable and wear resistant material.

12. The accessory of claim 1, wherein the first ring is an external ring and the second ring is an internal ring.

13. The accessory of claim 1, wherein some or all of the number of the connecting elements in the form of the straps are arranged with the joining means.

14. A method for reconfiguration of a gymnastic accessory, the gymnastic accessory comprising a twisting ring with a first, outer ring and with a second, inner ring, the twisting ring further including a twisting belt that includes a number of connecting elements at a periphery of the twisting belt, the connecting elements being fixed to the second, inner ring via a rope, wherein the second ring includes a groove continuous along an inner circumference of an inner second ring periphery, the groove including an opening adapted for receiving at least one connecting element, wherein the opening has a dimension which is narrower than a dimension of the groove; the method at least including the following steps:

releasing the connecting elements from the rope;

mounting longitudinally adjustable joining means to the twisting belt via the connecting elements at the periphery of the twisting belt;

mounting the longitudinally adjustable joining means to the second ring in the twisting ring via the rope at the inner second ring periphery of the second ring of the twisting ring.

15. A method according to claim 14, wherein the method further includes the following step:

mounting a mechanical snap-buckle between the twisting belt and the second, inner ring of the twisting ring, wherein one part of the snap-buckle is mounted on a twisting belt and wherein a second part of the snap-buckle is mounted on the second, inner ring of the twisting ring.

16. The method of claim 15, wherein the one part is a male part of the snap-buckle and the second part is a female part of the snap-buckle.

17. The method of claim 14, wherein the connecting elements are straps.

18. An accessory for performing gymnastic exercises comprising:

at least one twisting ring including a first ring and a second ring, the first ring and second ring coaxially connected and rotatable in relation to each other about a common axis, the first ring comprising an inner first ring periphery and an outer first ring periphery, the second ring comprising an inner second ring periphery and an outer second ring periphery and a groove continuous along an inner circumference of the inner second ring periphery, the inner first ring periphery and the inner second ring periphery being on an inner side of the at least one twisting ring towards the common axis, the outer first ring periphery and the outer second ring periphery being on an outer side of the at least one twisting ring away from the common axis, the outer second ring periphery being adjacent to the inner first ring periphery, at least two connectors symmetrically disposed on the outer first ring periphery, a twisting belt twistably disposable in the at least one twisting ring, a rope connectable to the at least two connectors and the twisting belt, connecting elements disposed on the inner second ring periphery, a number of rapid connect-disconnect coupling elements slidably disposed in the groove in the inner second ring periphery, a number of complementary coupling elements on the twisting belt, a number of strap elements coupled to the coupling elements, at least one strap element joining at least one coupling element with at least one complementary coupling element, an adjusting element on the at least one strap element or the coupling element for adjusting and retaining a length of the at least one strap element and thereby adjusting a spacing between the twisting belt and the second ring in the at least one twisting ring, an opening in the groove along the inner second ring periphery having a dimension narrower than a dimension of the groove, at least one locking element in the groove for firmly holding a portion of the at least one strap element received through the opening in the groove, a cutout in the second ring along the outer second ring periphery and a complementary cutout along the inner first ring periphery adjacent to the outer second ring periphery, and at least one connector element in the cutout and the complementary cutout making the second ring and the first ring rotatable with respect to each other along the common axis.

* * * * *